United States Patent [19]

Cook

[11] 3,952,619

[45] Apr. 27, 1976

[54] TUBE ASSEMBLY TOOL

[75] Inventor: Roger J. Cook, Highland, Mich.

[73] Assignee: Numatics, Incorporated, Highland, Mich.

[22] Filed: Feb. 27, 1975

[21] Appl. No.: 553,454

[52] U.S. Cl. ..... 81/420; 81/425 A

[51] Int. Cl.[2] ..... B25B 7/02

[58] Field of Search ..... 81/425 R, 41 B, 420, 81/5.1 R, 425 A; 7/5.6

[56] References Cited

UNITED STATES PATENTS

| | | | |
|---|---|---|---|
| 350,088 | 9/1886 | Trullinger | 7/5.6 |
| 427,127 | 5/1890 | Spencer | 81/420 |
| 768,161 | 8/1904 | Thompson | 81/425 R |
| 1,069,106 | 8/1913 | Brice | 81/425 R |
| 1,116,093 | 11/1914 | McKaig | 7/5.6 |
| 2,679,775 | 6/1954 | Fleming | 81/5.1 R |

*Primary Examiner*—James L. Jones, Jr.
*Attorney, Agent, or Firm*—Barnes, Kisselle, Raisch & Choate

[57] ABSTRACT

A tool for assembling press-in tube connections which comprises pivoted plier elements having an L-shaped nose with two pairs of opposed recesses at right angles to each other to grip tubes in the plane of the pliers, or perpendicular to the plane, with in-turned ends on the handle to limit the closure to prevent crushing of the tube while providing both a palm rest for application of pressure. The gripping jaws are made with cutters below the jaws and are also designed to facilitate the application of pressure to releasable couplings to assist in the removal of tube.

1 Claim, 3 Drawing Figures

TUBE ASSEMBLY TOOL

This invention relates to a Tube Assembly Tool and more particularly to a tool for assisting in the installation of plastic tube into metallic coupling units.

It has been common for many years to utilize metal piping or tubing for connecting elements of a pneumatic system, for example, the connection of a pressure source with a control valve and the connection of valves to working cylinders. In recent years, however, there has been a turning to plastic tubing inasmuch as the metal is very expensive and plastic tubing is now available which has suitable strength and endurability for pneumatic work.

Metal couplings for plastic tubing have been designed which require that the tubing be forced into a retaining socket where it will be securely locked. Representative couplings of this type are shown in United States patents to Sapy et al, U.S. Pat. No. 3,653,689 (1972), and to Cook and McGeachy, U.S. Pat. No. 3,817,562 (1974).

The present invention springs from a need to install plastic tubing in couplings quickly and easily. The plastic is too pliable and slippery to be gripped with the hands. An ordinary pair of pliers will abrade and cut the outer surface.

It is, therefore, an object of the present invention to provide a hand tool which will facilitate the installation of plastic tubing.

It is a further object to provide a hand tool which will grip the plastic tube without damage to the tube and which will permit a strong axial force to be applied to the tool manually.

A still further object is the provision of a tool which has means for limiting the compressive force that can be applied to a tube and which, at the same time, provides a comfortable shape for the application of hand pressure.

Another object is the hand tool which is so designed that it can be applied to a tube either transversely thereof or in alignment therewith to render it adaptable to use in areas difficult of access. In addition, opposed cutting edges are provided just below the gripping portions of the nose elements to avoid the necessity of a tool change for cutting tube into various lengths.

Other objects and features of the invention will be apparent in the following description and claims in which the construction of the tool and the principles of operation are set forth together with the best mode presently contemplated for the practice of the invention.

Figure 1:
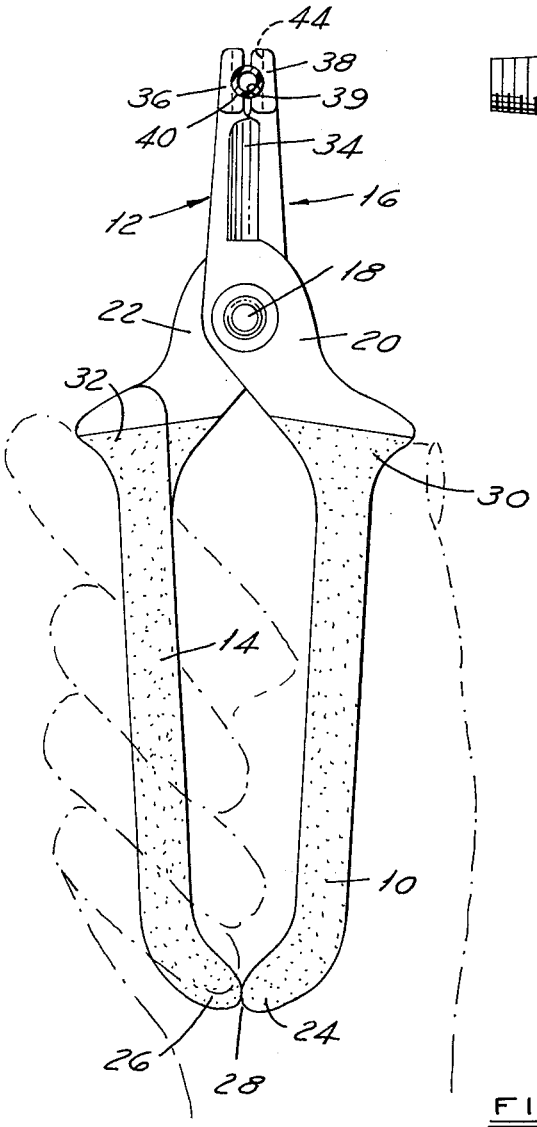

DRAWINGS accompany the disclosure and the various views thereof may be briefly described as:

FIG. 1, a plan view of the tube tool.

Figure 2:
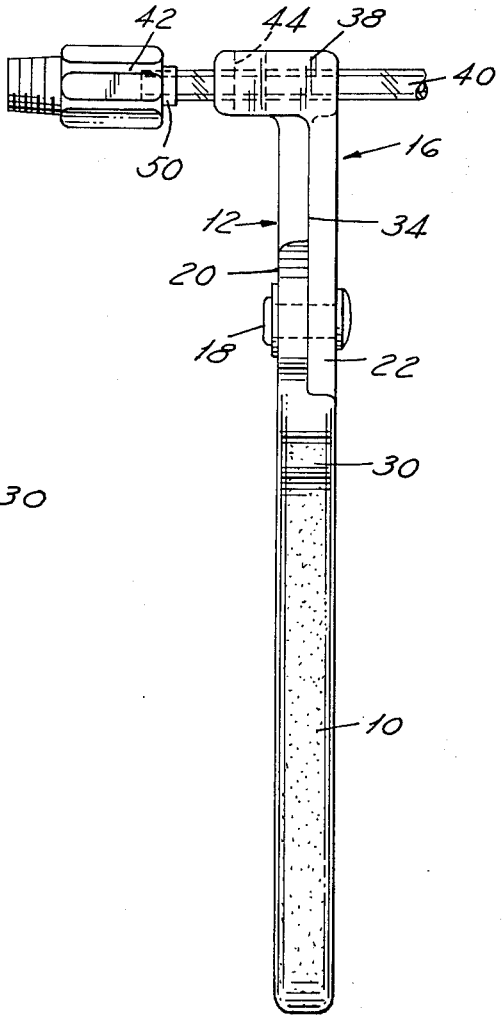

FIG. 2, a side view of the tool showing one manner of use.

Figure 3:
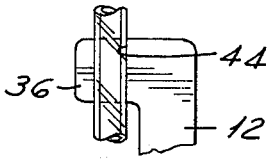

FIG. 3, a fragmentary view showing an alternate use.

With reference to the drawings, in FIG. 1 the hand tool is shown in a closed position. There are two parts pivoted together, a right hand handle 10 having a left-hand working end 12 and a left-hand handle 14 having a right-hand working end 16. The parts are pivoted at 18 in the cross-over portions 20 and 22, respectively.

The handles 10 and 14 have digital ends 24 and 26, respectively, which turn in toward each other and meet at 28 as shown in FIG. 1. This contact prevents complete closing of the working ends of the tool to avoid crushing the tube being held. The handles diverge slightly from the digital ends and turn outwardly just below the pivot area to form nubs or shoulders 30 and 32 which form comfortable contact areas for the thumb and forefinger when the tool is firmly gripped. The handles are preferably coated with a plastic sheath for comfort of the user.

The working ends 12 and 16 of the tool each have a sharpened blade 34 formed just below the tube gripping portions to form a scissors type cutter. This enables the operator to cut the tube quickly at convenient lengths without changing the hand tool. The blades each project inwardly past the meeting planes of the nose so the cutting edges will overlap in scissor fashion. This provides the most effective cutting action for the plastic tube.

Above the cutters 34 at the digital ends of the working part of the tool are opposed gripper heads 36 and 38. These heads from an L with the portions 12 and 16 in that a portion of each head extends transversely to one side of the head. Each head has on its inner surface a segmental groove 39 which is not a complete semicircle and which extends on an axis transverse of the tool as shown in FIGS. 1 and 2. Thus, the tool can grip a tube 40 in the opposed grooves which is to be forced into the coupling 42.

Shown in the dotted lines in FIGS. 1 and 2 is a second pair of opposed grooves 44 in the offset portions of the head so that tube 40 can be gripped as shown in FIG. 3.

It will be noted that the coupling 42 has a small projection 50. This is a release collet, which, when pressed inwardly, will release the inserted tube. The nose ends of the heads 36 and 38 are designed to contact this small projection to press it in to a release position.

Thus, there is shown a versatile and convenient tubes insert tool which is comfortable to the hand of the user and can be used bi-directionally to allow access to small areas and which can serve also as a cutter and a release device. The inturned ends 24, 26 close to provide a comfortable rounded end for the lower palm of the hand as a pressure area.

What is claimed as new is:

1. A hand tool for use in forcing plastic tubing into a retaining socket which comprises:

a. a pair of handles lying in a plane, b. a cross-over portion on each of said handles, c. means pivoting said handles together at the cross-over portions, d. a head end on each of said cross-over portions positioned to provide a clamping action, each of said head ends having a portion extending laterally away from the general plane of the handles, said laterally extending portions having a first facing smooth surface groove on an axis extending transverse to the plane of said handles and a second facing smooth surface groove on an axis perpendicular to said first groove parallel to the plane of said handles, said grooves being shaped to receive a portion of a sidewall of a tube to be gripped, e. each of the handles being formed at the digital ends with a curved portion extending in the direction of the other handle and dimensioned to contact to prevent full closing of the head ends on each handle and having a curved, outwardly extending nub adjacent the pivoting means to serve as pressure areas for the thumb and forefinger of a user, and f. blades formed on said head ends between said laterally extending portions and said pivoting means having portions terminating at cutting edges which respectively lie in a common plane whereby said blades will overlap in scissors fashion as said head ends are brought together to serve as a cutter for plastic tubing.

* * * * *